United States Patent [19]

Mahoney

[11] Patent Number: 4,458,810

[45] Date of Patent: Jul. 10, 1984

[54] PACKAGE OF SCENT IMPREGNATED TISSUES

[76] Inventor: Pamela Mahoney, 7503 Valley Meadows, Fort Wayne, Ind. 46815

[21] Appl. No.: 476,501

[22] Filed: Mar. 18, 1983

[51] Int. Cl.[3] ..... B65D 85/62; B65D 81/24; B65H 1/00; A47K 10/20

[52] U.S. Cl. ..... 206/210; 206/494; 206/621; 206/524.3; 221/63

[58] Field of Search ..... 206/210, 494, 449, 621, 206/524.3; 221/63

[56] References Cited

U.S. PATENT DOCUMENTS

| | | | |
|---|---|---|---|
| 1,755,998 | 9/1930 | Greenberg . | |
| 2,001,046 | 5/1935 | Welch . | |
| 2,598,823 | 6/1952 | O'Grady . | |
| 2,933,431 | 4/1960 | Sperouleas . | |
| 3,325,003 | 6/1967 | Bilezerian . | |
| 3,784,055 | 1/1974 | Anderson | 221/63 |
| 3,862,703 | 1/1975 | Dutcher | 221/63 |
| 4,156,493 | 5/1979 | Julius | 221/63 |
| 4,185,754 | 1/1980 | Julius | 206/210 |
| 4,420,080 | 12/1983 | Nakamurr | 206/494 |

*Primary Examiner*—William T. Dixson, Jr.
*Attorney, Agent, or Firm*—Jeffers, Irish & Hoffman

[57] ABSTRACT

Scent impregnated tissues are provided in a substantially airtight container having a resealable lid. The tissues have disposed between selected ones thereof individual scent-carrying layers carrying a scent-producing material therewith. The arranged scent-carrying layers uniformly impregnate the absorbent disposable tissues with the scent thereof, and the container and lid insure that the tissues and layers remain in a virtually hermetically sealed environment.

9 Claims, 2 Drawing Figures

PACKAGE OF SCENT IMPREGNATED TISSUES

BACKGROUND OF THE INVENTION

This invention pertains to tissues, and more particularly to absorbent disposable tissues impregnated with the scent of an aromatic material and packaging therefor.

Many kinds of tissues, and particularly facial tissues, are available today, some being impregnated with the scent of various perfumes or other aromatic or medicinal materials. Some of these tissues are first impregnated with the scent and thereafter packaged in a thin cardboard container. The container is provided with a perforated opening which is removed to allow access to the tissues therein. These containers are usually not coated with a sealant, nor is the opening resealable with a lid or cover in order to minimize the escape of the scent from the interior of the container. Consequently, tissues removed from the container, after it has been opened for an extended period of time, tend to possess only a faint scent of the impregnated material.

Other types of impregnated tissue have two different chemicals or scent-producing materials applied thereto on different portions of the tissue, and upon bringing the two different chemicals into contact, by rubbing for example, a reaction takes place which releases the desired scent. Although more efficient than the above described tissue in minimizing the loss of the scent, this particular type of tissue is more expensive and difficult to make than if only one chemical or scent-producing material is used. Furthermore, extreme care must be taken during packaging to insure that the two different chemicals do not come into contact from the same or adjacent tissues.

Still another type of treated tissue is the type wherein a stack of tissues are sealingly packaged with an impervious covering and then placed in a container, for example, a cardboard box. The stack of tissues are usually not scented prior to stacking, and are impregnated with a scent of material coated on the inner surfaces of the impervious covering. The impervious covering is provided with a perforated opening so that individual tissues are accessible through the opening in the container. Although this dispenses with the undesirable feature of utilizing two chemicals, as in the above described tissue, only the six exterior sides of the stack of tissues are directly in contact with the coated inner surface of the impervious covering. Consequently, except for the top and bottom tissues in the stack, the concentration of the scent impregnated in each tissue decreases from the peripheral edge portions to the center portions thereof. This is undesirable since it is the center portion of the tissue which is generally used.

SUMMARY OF THE INVENTION

The present invention overcomes the undesirable features and disadvantages of the prior art by providing improved scent impregnated tissues packaged in a substantially hermetically sealed container.

The container of the present invention is provided with an opening and a resealable lid movably connected to the container for the closing thereof. The inner surface of the lid is provided with a seal made of a resilient and substantially impermeable material, such as a plastic, rubber, or like material. When the lid is closed, the seal is in abutting engagement with the periphery of the opening to provide a substantially air-tight seal, thereby minimizing the escape of the scent from the container.

Further minimization is provided by coating either the outer or inner, or both, surfaces of the container with a sealant, such as a wax material. As described, the container of the present invention preserves the impregnation of the scent in each tissue such that the concentration of the scent in the last tissue is nearly the same as that of the first tissue, providing the resealable lid is properly closed when the container is not in use.

Another advantage with the tissues of the present invention is that only one chemical or scent-producing material is used, thereby eliminating the need of exercising extreme care in maintaining the separation of two different chemicals or scent-producing materials as in the above-described prior art.

Still another advantage of the tissues of the present invention is the method by which each tissue is imregnated with the scent of the desired chemical or scent-producing material. Layers of scent-carrying material are individually placed between selected ones of the tissues in the container, for example, between every fifth, tenth, or other number of tissues. The layers of the scent-carrying material are of the same general size as the tissues, and are of a sponge-like or porous texture so as to carry the scent-producing material, thereby uniformly impregnating the tissues and eliminating decreasing concentration of scent from the peripheral edges toward the center areas thereof. Furthermore, the tissues and the layers of scent-carrying material are more easily packaged since there is no requirement to first enclose the stack of tissues with an impervious covering.

In one form of the invention, there is provided improved scent impregnated tissues comprising a container having an opening and a lid movably connected to the container to provide access to the interior thereof. Within the container, there is provided a plurality of absorbent tissues having therebetween a plurality of scent-carrying layers carrying a scent-producing material. The scent-producing material impregnates the tissues so that each impregnated tissue removed from the container carries the scent therewith. The lid of the container is resealable to minimize the escape of the scent therefrom.

It is an object of the present invention to provide improved scent impregnated tissues packaged in a substantially air-tight container.

Further objects of the present invention will appear as the description proceeds.

BRIEF DESCRIPTION OF THE DRAWINGS

The above-mentioned and other features and objects of this invention, and the manner of obtaining them, will become more apparent and the invention itself will be better understood by reference to the following description of an embodiment of the invention taken in conjunction with the accompanying drawings, wherein.

DESCRIPTION OF A PREFERRED EMBODIMENT

Figure 1:
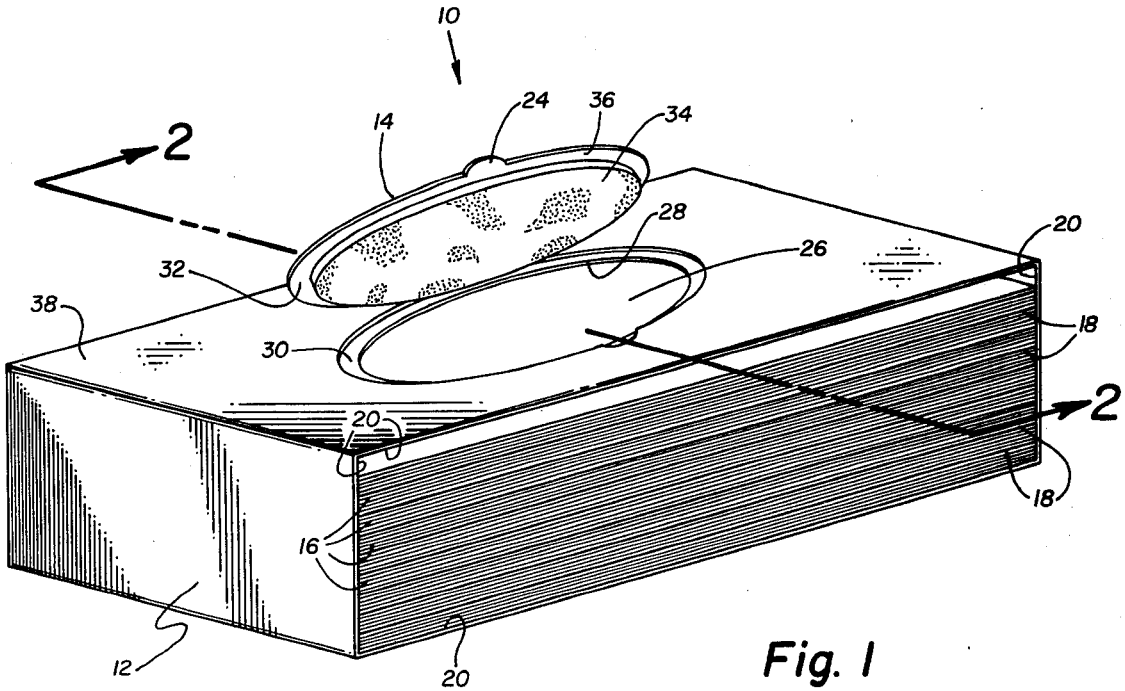
FIG. 1 is a perspective view, partially broken away, of a preferred embodiment of the present invention with the lid in the open position.
Figure 2:
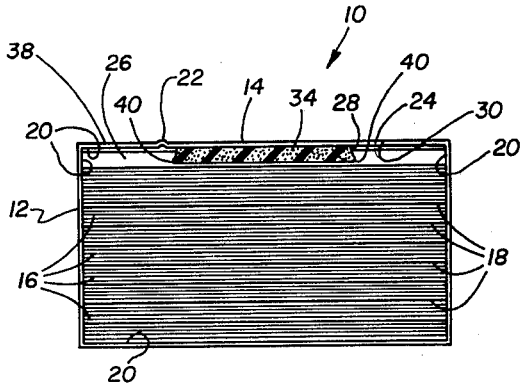
FIG. 2 is a sectional view of FIG. 1 with the lid in the closed position and taken along line 1-1 and viewed in the direction of the arrows.

The packaged scent impregnated tissues 10 of the present invention are illustrated in FIGS. 1 and 2 and generally comprise container 12 with lid 14 and a stack of absorbent disposable tissues 16 therein. Selectively placed between tissues 16 are layers 18 of a scent-carrying material; layers 18 being made of a scent-carrying material having sponge-like or porous qualities such as certain forms of plastics, rubber, and cellulose. Layers 18 may also be made of a woven fabric material. Although these materials are preferred, other materials may be used which are capable of absorbing or carrying a scent. Layers 18 are saturated with a scent-producing material, such as camphor, thymol, menthol, eucalyptus, or mixtures thereof. Other aromatic or medicated materials may be used, but the four mentioned materials are preferred since they are generally used to unplug or unclog sinuses and nasal passages.

The scent-producing material is applied to layers 18 in either a powder form or in solution with a solvent which evaporates after the layers 18 have been saturated with the scent-producing material.

Layers 18 are selectively placed between tissues 16 to insure their impregnation with the scent of the scent-producing material when in container 12. A single layer 18 may be provided between every fifth, tenth, or similar number of tissues 16, and the number of tissues 16 between two layers 18 will depend upon the concentration of the scent-producing material in layers 18. For example, if layers 18 are made of a material carrying a high concentration of the scent-producing material, then layers 18 may be placed between a greater number of tissues 16 than if layers 18 are made of a material carrying a lesser concentration of the scent-producing material. Those materials preferred for layers 18 are those which are capable of carrying a higher concentration of the scent-producing material since fewer layers 18 are then required for packaged scent impregnated tissues 10.

Layers 18 also preferably have substantially the same surface area as tissues 16 so that tissues 16 are uniformly impregnated across their surfaces by the scent-producing material.

When tissues 16 and layers 18 are properly stacked, they are then placed within container 12 and sealed therein. Container 12 provides a substantially hermetically sealed environment for tissues 16 and layers 18 to minimize the escape of the scent therefrom. To accomplish this, container 12 is coated with a sealant 20, such as a wax material, along its interior surface areas. Naturally, container 12 may also be coated with sealant 20 on its exterior surfaces, or both interior and exterior surfaces.

Lid 14 is defined in container 12 by perforations (not shown) except along a portion 22 thereof which serves as a hinge or pivot point for lid 14. Lid 14 is also provided with a pull-tab 24, which upon being pulled separates lid 14 from container 12 along the perforations (not shown). It should be noted that the perforations outlining lid 14 do not penetrate completely through container 12, thereby insuring a substantially air-tight or hermetic seal for container 12. Upon pulling lid 14 upwardly, interior 26 of container 12 is exposed through opening 28 created when the perforations (not shown) are broken.

With lid 14 in the open position, a recessed collar or flange 30 is viewable along the periphery of opening 28.

Attached to the inner surface 32 of lid 14 is a seal 34 preferably made of a resilient and substantially impermeable material, such as plastic, rubber or the like. As illustrated in FIG. 1, seal 34 does not completely cover inner surface 32 of lid 14, thereby leaving a peripheral portion 36, which upon closing lid 14 engages recessed flange 30 of container 12 so that lid 14 and top 38 of container 12 are substantially coplanar.

Seal 34 is just slightly larger than opening 28 so that it force fully abutts against the periphery thereof when lid 14 is closed. This is clearly illustrated in FIG. 2 where the periphery of opening 28 is pressed against seal 34 causing a peripheral bulge 40. By having seal 34 so engage opening 28, a substantially air-tight or hermetic seal is provided between lid 14 and opening 28 in container 12 to virtually eliminate the escape of the scent therefrom.

In use, the user pulls upwardly on pull tab 24 to separate lid 14 along perforations in container 12 to expose opening 28 and tissues 16. Since the inner surfaces of container 12 and lid 14 are coated with a sealant 20, tissues 16 are maintained in a substantially hermetic environment filled with a scent provided by layers 18. After opening lid 14 and withdrawing a desired number of tissues 16, the user then closes lid 14 to forcefully engage seal 34 with the periphery of opening 28. Lid 14 with seal 34 is prevented from being accidentally pushed or positioned within the interior 26 of container 12 by peripheral portion 36 engaging flange 30.

As tissues 16 are used, exposed layers 18 may be removed to provide access to the remaining tissues 16, which are continually supplied with the scent of the other remaining layers 18. As long as the user maintains the lid 14 in the closed position when not using tissues 16, tissues 16 remain unformly impregnated by the remaining layers 18.

While this invention has been described as having a preferred embodiment, it will be understood that it is capable of further modifications. This application is therefore intended to cover any variations, uses, or adaptations of the invention following the general principles thereof, and including such departures from the present disclosure as come within known or customary practice in the art to which this invention pertains and fall within the limits of the appended claims.

What is claimed is:

1. A package of scent impregnated tissues, comprising:

a container having an opening and a lid movably connected thereto to provide access to the interior of said container through said opening, said lid being resealable over said opening, said container and said lid being substantially impermeable to said scent, a plurality of absorbent disposable tissues in said container, and a plurality of scent-carrying means being individually interposed between selected adjacent ones of said absorbent disposable tissues, and carrying a medicative material therewith, said absorbent disposable tissues being impregnated with a scent from said medicative material, whereby each said impregnated tissue removed from said container carries said scent therewith.

2. The tissues of claim 1 wherein each said scent-carrying means is individually disposed in overlying relationship on a selected one of said tissues to thereby uniformly impregnate the surfaces of said tissues with said scent.

3. The tissues of claim 2 wherein each said scent-carrying means is a thin layer of a porous material.

4. The tissues of claim 3 wherein said porous material is a plastic material.

5. The tissues of claim 3 wherein said porous material is a rubber material.

6. The tissues of claim 3 wherein said porous material is a cellulose material.

7. The tissues of claim 1 further comprising a sealing member on the inner surface of said lid, said sealing member being made of a resilient and substantially impermeable material and being in abutting engagement with the periphery of said opening when said lid is closed thereover to substantially hermetically seal said opening, thereby minimizing the escape of said scent from said container.

8. The tissue of claim 1 wherein said medicative material is selected from the group consisting of camphor, thymol, menthol, eucalyptus, and mixtures thereof.

9. The tissues of claim 1 wherein at least portions of the surfaces of said container and said lid are coated with a sealant.

* * * * *